US005979096A

United States Patent [19]

Ferdinandsen et al.

[11] Patent Number: 5,979,096

[45] Date of Patent: Nov. 9, 1999

[54] MEANS FOR DISPLAYING PHOTOGRAPHS

[75] Inventors: Alexander Ferdinandsen; Bendix Ferdinandsen, both of Milan, Denmark

[73] Assignee: Zoomas ApS, Gilleleje, Denmark

[21] Appl. No.: 08/302,864

[22] PCT Filed: Jan. 11, 1994

[86] PCT No.: PCT/DK94/00019

§ 371 Date: Sep. 14, 1994

§ 102(e) Date: Sep. 14, 1994

[87] PCT Pub. No.: WO94/15800

PCT Pub. Date: Jul. 21, 1994

[30] Foreign Application Priority Data

Jan. 14, 1993 [DK] Denmark ..... 9300020
Jun. 10, 1993 [DK] Denmark ..... 0682/93

[51] Int. Cl.[6] ..... B44C 5/02

[52] U.S. Cl. ..... 40/768; 40/772

[58] Field of Search ..... 40/158.1, 594, 40/768, 776, 771, 649, 772; D6/300, 309

[56] References Cited

U.S. PATENT DOCUMENTS

| | | | |
|---|---|---|---|
| D. 32,804 | 6/1900 | Clements | D6/300 |
| 567,134 | 9/1896 | Harris | 40/158.1 |
| 816,861 | 4/1906 | James | 40/768 |
| 3,587,187 | 6/1971 | Sibley | 40/776 |
| 3,694,947 | 10/1972 | Mukai et al. | 40/771 |
| 3,707,053 | 12/1972 | Itano | 40/158.1 |
| 3,849,917 | 11/1974 | Bergh et al. | 40/649 |
| 4,129,671 | 12/1978 | Greenberg | D6/300 X |
| 4,332,095 | 6/1982 | Tanney | 40/158.1 |
| 5,141,466 | 8/1992 | Catizone . | |
| 5,248,536 | 9/1993 | Du Katz | 40/594 X |
| 5,261,174 | 11/1993 | Blegen | 40/594 X |

FOREIGN PATENT DOCUMENTS

| | | |
|---|---|---|
| 9002053 | 3/1990 | WIPO . |
| 9108915 | 6/1991 | WIPO . |

*Primary Examiner*—Joanne Silbermann
*Attorney, Agent, or Firm*—Pillsbury Madison & Sutro LLP

[57] ABSTRACT

A mask is adapted for superimposing on a photograph to accentuate a portion of the photograph. The mask is made of a thin sheet of plastic, by means of, e.g., colored raster which is opaque in a periopheral region surrounding a transparent, central area without raster. The peripheral region and the central area are separated by a relatively narrow, transitional zone with increasing distance between the raster, so that the transitional zone gradually fades out into the transparent, central area. The mask may be employed in the same simple manner as a passe-partout frame for accentuating one particular portion of a photograph, and with the same good visual effect achieved by a traditional phototechnical method for integrally providing a photograph with a neutral peripheral region gradually fading out via a soft transitional zone into the desired portion of the photograph.

8 Claims, 2 Drawing Sheets

MEANS FOR DISPLAYING PHOTOGRAPHS

BACKGROUND OF THE INVENTION

1. Field of the Invention

The invention relates to a mask for superimposition onto a photograph, to thereby accentuate a portion of the photograph.

2. Background of the Invention

Passe partout frames have for many years been a frequently employed means for showing a particular portion of a photograph. Such frames are made of a sheet of paper or cardboard having a cut-out, oval portion that allows the desired portion of the photograph to be freely visible when the photograph is mounted within the frame, while the rest of the photograph is hidden by the frame. Consequently, a viewer will immediately focus attention directly on the exposed portion of the photograph without being diverted by other images within the viewer's field of vision.

One particular portion of a photograph which is frequently accentuated, when arranged in a passe partout frame, is a portrait view of a person. A portrait is perceived much differently as compared to a photograph that includes the full figure of a person and the surroundings at the place the photograph was taken. When the photograph is framed as a portrait, the viewer immediately focuses attention on it. Thus, a visual effect is obtained in which the framed portrait is accentuated and manifests itself clearly to the viewer, who thus perceives the portrait far more intensely than the viewer would when contemplating the photograph in full.

This attractive effect is, however, to a certain extent reduced by the sharp edge along the cut-away portion of the frame, which provides for an abrupt transition from the portrait to the frame. Thus, the frame itself becomes sufficiently perceptible to attract part of the viewer's attention.

It has been sought to remedy the above mentioned drawback through a purely phototechnical method. When using this method, a peripheral region of a photograph is dimmed during the shooting of the negative or at a later time, when the prints are made, so that the central area appears with 100% sharpness and gradually fades out to vanish completely at a surrounding, neutral peripheral region. This peripheral region may be provided with uniform coloration, which does not by itself capture the eye. On the contrary, the smooth fading out directs the eye unnoticed towards the central portion of the photograph, the peripheral region in reality not being perceived. Thus, the resulting visual effect is optimal, allowing the central portion of the photograph to be studied without disturbing interference from other images within the field of sight, leading up to the central portion, which invariably would attract the attention of the viewer.

Thus, a distinct demand exists for a mask using means just as simple as a passe partout frame, which provides a visual effect as good as the one realized by the above mentioned phototechnical method.

SUMMARY OF THE INVENTION

According to the novel and distinctive features of the invention, a mask is provided, made of a thin sheet having an opaque, peripheral region and with an intermediate, transitional zone, across which the opaque, peripheral region gradually fades out to a transparent, central area. This mask may be employed in the same simple manner as a passe partout frame for accentuating a particular portion of a photograph, and with the same good visual effect achieved by, phototechnically, isolating a portion of a photograph by letting it gradually fade out into a neutral plane.

One particular inexpensive and simple embodiment of the mask is, according to the present invention, achieved when the mask is made of a transparent thin sheet with, e.g., black or white coloration, with preferably 100% coverage in the peripheral region, said coverage gradually decreasing through the transitional zone to 0% in the central area.

The coloration may advantageously be carried out using a repro- and printing technique, combining the size of the raster with the intensity of the raster to achieve the desired coverage. Such a mask is particularly suitable for mass production at a modern repro- and printing-plant.

Further, the thin sheet may appropriately be made of a plastics material, and, to render the mask easily attachable onto a photo, an adhesive may be applied to one of the sides of the thin sheet; the adhesive may be of a kind that allows the mask to be removed without damaging the photograph.

BRIEF DESCRIPTION OF THE DRAWINGS

The invention will be explained in further detail with reference to the drawings of which.

DETAILED DESCRIPTION OF THE INVENTION

Figure 1:
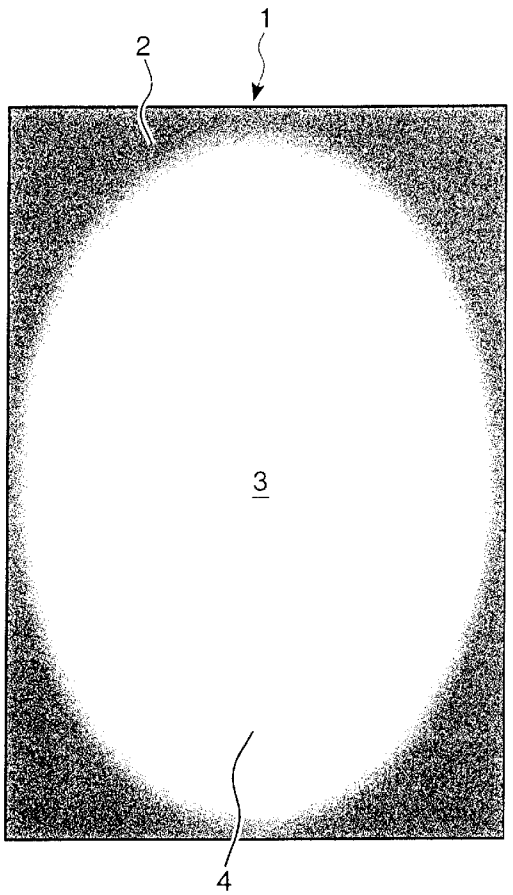
FIG. 1 shows the mask according to the invention, FIG. 2 schematically represents a photograph of a person.

FIG. 1 shows mask 1 made of a transparent plastic thin sheet and colored on at least one side to form opaque, peripheral region 2 surrounding transparent, central area 3, with intermediate, transitional zone 4, across which the opaque, peripheral region gradually fades out into the transparent, central area. In the drawings, the central area is shown as being oval in shape; this area may, however, within the scope of the invention, take any geometrical shape, e.g., round or rectangular.

Figure 2:
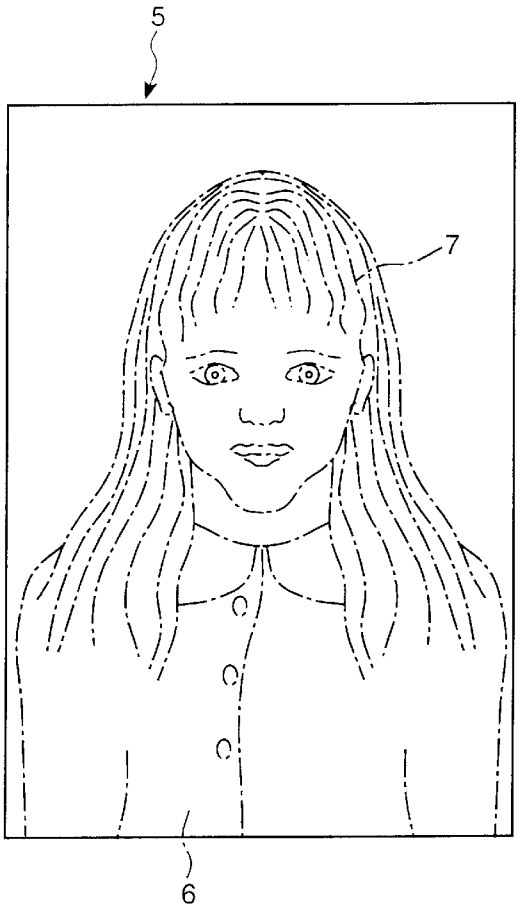

FIG. 2 represents a photograph 5. The photograph illustrates the upper part of person 6 and portrait portion 7 which is to be accentuated.

Figure 3:
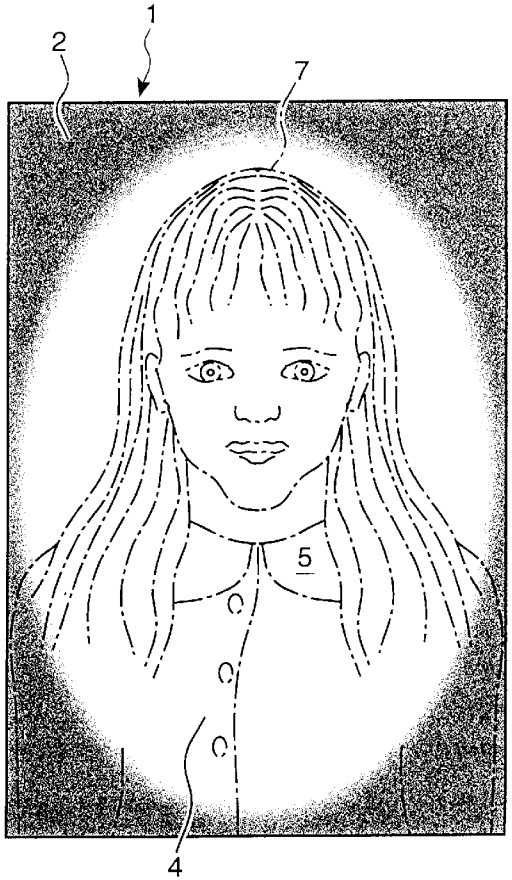
FIG. 3 shows the mask of FIG. 1 placed upon the photograph of FIG. 2.

This accentuation is carried out by placing mask 1 upon photograph 5, as shown in FIG. 3. This is done in the same simple and easy manner as in the case of a passe partout frame. The effect is, however, much stronger, being fully equal to the visual effect attained by phototechnically letting one specific portion of a photograph gradually fade out towards a neutral, peripheral region.

Figure 4:
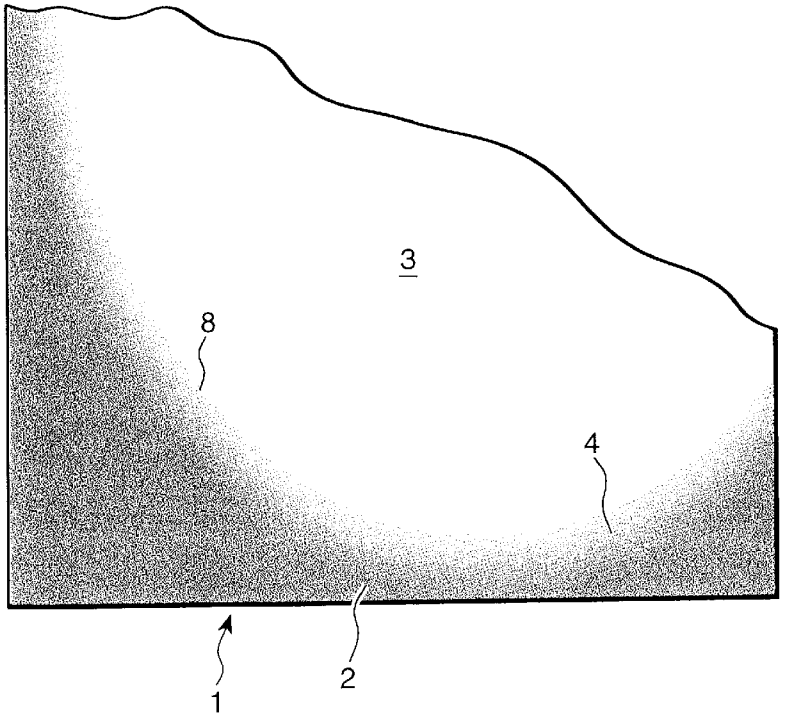
FIG. 4 is a partial, enlarged view of the mask of FIG. 1.

FIG. 4 illustrates, in part, an enlarged view of the mask shown in FIG. 1. In this case, the coloration of the peripheral region 2, and the transitional zone 4, has been carried out using a special reprotechnique, using closely spaced, or even mutually joined raster 8 in the peripheral region, while the density and possibly the size of the raster is gradually reduced, as shown, in the transitional zone. The raster may be of any color suitable including, e.g., black or white.

In order to achieve the desired effect, the transitional zone should have a suitable width. According to the invention, this may vary between 1 and 10% of the width of the shorter side of the photograph, preferably between 2 and 5%, and still preferably between 3 and 4%. Thus, for a mask which is sized to the photograph it is to be superimposed upon, the transitional zone may vary between 1 and 10% of the width of the shorter side of the mask.

Figure 5:
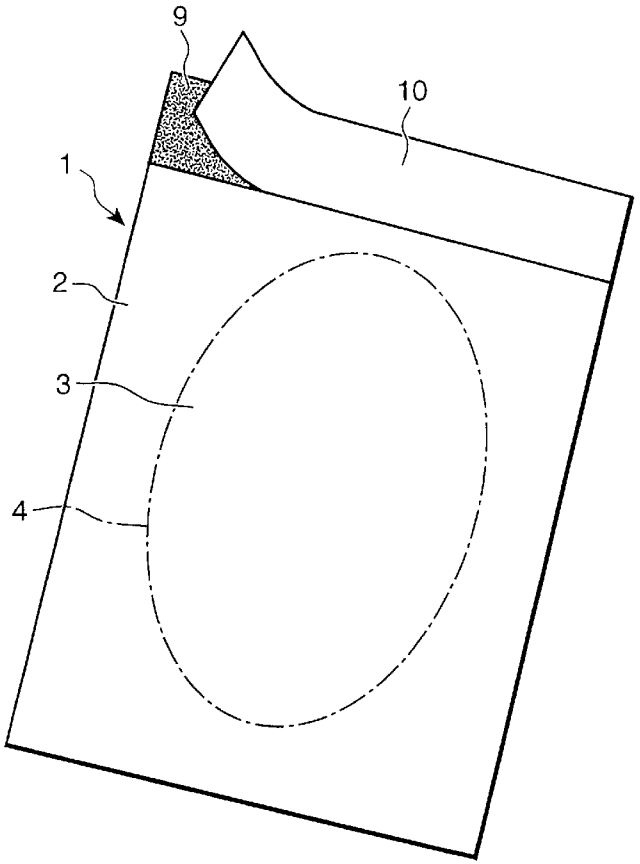
FIG. 5 is a perspective view of a mask carrying an adhesive.

FIG. 5 illustrates an embodiment, wherein a strip of adhesive 9 has been applied to mask 1, along one of the shorter edges of the rear of the mask. The adhesive is protected by coverstrip 10, which is drawn off when the mask is to be adhered onto a photograph. The adhesive may have a low adhesive strength to allow for subsequent removal of the mask from the photo, without causing any damage on it. The mask of FIG. 5 has only been partially covered by adhesive; the adhesive may, however, be applied to larger parts of the mask or to the entire mask. In the latter case, the adhesive itself must be transparent to render the motif visible at the central area. When the central area is also adhered onto the photograph, an intimate connection is established, which does not allow for the creation of air spaces between the mask and the photograph that may otherwise cause undesired light effects, and possibly in time collect dust, causing a blurring of the exposed portion of the photograph.

It should be recognized that when the above mentioned, central area is characterized as transparent, this means that a portion of the photograph will be visible through the mask. This does not necessarily mean that the central area should be 100% transparent. In some cases, an interesting effect may be achieved by applying a weak color to the area, or by simply, to some extent, reducing the degree of transparency.

The mask may further be provided with more than one coloration in the peripheral region and in the transitional zone. "Color" in this context is also meant to include black and white. An example would be a coloration starting off as white in the central area and changing through grey colors getting darker and to black at the edge of the mask. Such a variation that may also be carried out using other colors will invariably lead the eye of the viewer through colors continuously becoming lighter to the exposed portion of the photograph in the central area. By using several colors, a beautiful decorative effect is obtained.

It was suggested to make the mask from a plastic thin sheet of plastic. The mask may also, however, be made from any other transparent material, such as, e.g., glass, which may further form part of a frame, such as a picture frame.

We claim:

1. A mask for superimposing upon a photograph having a portion which is to be accentuated, characterized by the mask being made of a thin sheet having a substantially opaque, peripheral region which, across a transitional zone, gradually fades out into a transparent, central area.

2. A mask as claimed in claim 1, characterized by the mask being made from a transparent thin sheet having black or white coloration with a coverage of preferably 100% in the peripheral region, from where said coverage is gradually reduced to 0% at the central area.

3. A mask as claimed in claim 1, characterized by said coloration being achieved through a repro- and printing technique, employing a combination of raster size and raster density for realizing the desired coverage.

4. A mask as claimed in claim 1, characterized by the transitional zone having a width of between 1 and 10% of the shorter side of the mask.

5. A mask as claimed in claim 1, characterized by having an oval, central area.

6. A mask as claimed in claim 1, characterized by the thin sheet being made of a plastics material.

7. A mask as claimed in claim 1, characterized by an adhesive being applied, at least partially along the edge of one of the sides of the thin sheet.

8. A mask as claimed in claim 7, characterized by the adhesive being of the kind that allows for the mask to be adhered onto a photo, and removed without damaging the photo.

* * * * *